US006554725B1

(12) United States Patent
Schaar

(10) Patent No.: US 6,554,725 B1
(45) Date of Patent: Apr. 29, 2003

(54) WEIGHT-FORWARD COMPOSITE ARROW SHAFT

(76) Inventor: John G. Schaar, 1048 W. Greenway Dr., Tempe, AZ (US) 85282

( * ) Notice: Subject to any disclaimer, the term of this patent is extended or adjusted under 35 U.S.C. 154(b) by 202 days.

(21) Appl. No.: 09/718,217

(22) Filed: Nov. 22, 2000

(51) Int. Cl.[7] ..... F42B 6/04
(52) U.S. Cl. ..... 473/578
(58) Field of Search ..... 473/578

(56) References Cited

U.S. PATENT DOCUMENTS 2,182,951 A * 12/1939 Sweetland
2,694,661 A * 11/1954 Meyer
6,251,036 B1 * 6/2001 Wu et al. ..... 473/578
6,277,041 B1 * 8/2001 Fenn ..... 473/578

* cited by examiner

*Primary Examiner*—John A. Ricci

(57) ABSTRACT

An improved arrow shaft comprised of a core of substantially round, very lightweight, porous material, with the porous core having sections that have different diameters at various points along the length of the arrow shaft, with the lightweight core materials being overwrapped with different thickness' of reinforcing materials such that the resulting outside diameter of the finished arrow shaft has substantially parallel surfaces over the entire length of the shaft and the finished shaft has a substantially constant circumference and outside diameter along its entire length. The inventive composite arrow shaft incorporates different thickness' and weights of reinforcement materials, strategically placed along it's length, in a manner that results in providing, in an integral manner, proper front to back balance in the finished arrow, with the proper balance achieved by using the same weight point, point insert, nock, nock insert, and fletching materials, regardless of the length the shaft is cut off at. The preferred embodiment of the inventive arrow shaft includes end sections at each end that have greater thicknesses of reinforcement materials overlaying the core, than at other intermediate sections of the shaft, with the increased reinforcement materials at each end of the shaft serving to increase, in an integral manner, the strength of the shaft in these areas. The preferred embodiment of the inventive arrow shaft also includes at least one other section intermediate the end sections of the shaft that also has greater thicknesses of reinforcement materials along it's length than do some other sections of the shaft that are intermediate the additionally-reinforced end sections.

9 Claims, 5 Drawing Sheets

Figure 1:
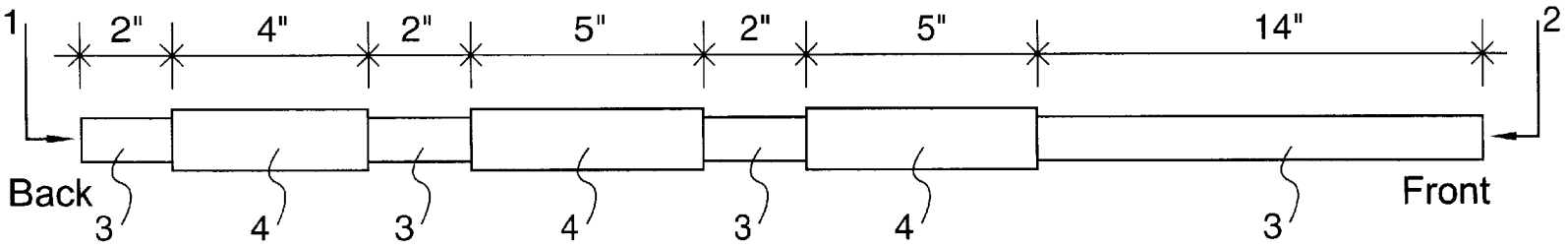

| | Reinforceing Material Thickness in inches | | | | | | | Total Reinforceing Material Thickness in inches | | Outside Diameter in inches | Core Material Grains/Inch | | Overall Grains/Inch | |
|---|---|---|---|---|---|---|---|---|---|---|---|---|---|---|
| | Hoop (a) | Warp (b) | Hoop (c) | Warp (d) | +45° (e) | -45° (f) | Gel Coat (g) | (SC) | (LC) | (h) | (SC) | (LC) | (SC) | (LC) |
| Size 0 | .004 | .008 | .004 | .008 | .004 | .004 | .002 | .034 | .022 | .288 | 1.2 | 1.5 | 9.75 | 7.3 |
| Size 1 | .004 | .008 | .004 | .012 | .004 | .004 | .002 | .038 | .026 | .296 | 1.2 | 1.5 | 10.9 | 7.6 |
| Size 2 | .004 | .008 | .008 | .012 | .004 | .004 | .002 | .042 | .030 | .304 | 1.2 | 1.5 | 12.1 | 9.3 |
| Size 3 | .004 | .008 | .008 | .016 | .004 | .004 | .002 | .046 | .034 | .312 | 1.2 | 1.5 | 13.3 | 10.46 |
| Size 4 | .004 | .008 | .012 | .016 | .004 | .004 | .002 | .050 | .038 | .320 | 1.2 | 1.5 | 15.26 | 12.56 |

FIG. 7B

WEIGHT-FORWARD COMPOSITE ARROW SHAFT

II. PRIOR ART REFERENCES

| | | |
|---|---|---|
| 2/1975 | Groner | 3,868,114 |
| 9/1977 | Troncoso, Jr. | 4,050,696 |
| 5/1980 | Simo | 4,203,601 |
| 7/1980 | Kosbab | 4,210,330 |
| 8/1985 | Schaar | 4,533,146 |
| 11/1987 | Schaar | 4,706,965 |

III. BACKGROUND OF THE INVENTION

The general background of the invention up until about 1984 was well described in prior art reference U.S. Pat. No. 4,533,146. This patent application incorporates that background section by reference. To that background reference, I now add the prior art reflected in U.S. Pat. Nos. 4,533,146 and 4,706,965, and the additional background which follows.

References U.S. Pat. Nos. 4,533,146 and 4,706,965 sought to define a combination of arrow sub-components that could be assembled in a manner which, when combined, provided additional reinforcements in the area near each end of the arrow shaft, and near the center of the arrow shaft, and which could be configured, by trimming prescribed amounts of material from excessively long point inserts, nock inserts, points, and nocks, so as to achieve proper front-to-back balance in the finished arrow.

It was found to be the case that, in 1984, a single very stiff arrow shaft could indeed be used with virtually all bow types, and draw lengths, and bow draw weights, especially bows suitable for use as hunting bows, by using the compliment of components as defined in U.S. Pat. Nos. 4,533,146 and 4,706,965.

However, it has also proven to be the case that as compound bows continued to evolve after 1985, they often incorporated pulley systems that resulted in very high levels of draw force reduction at full draw. At the time U.S. Pat. Nos. 4,533,146 and 4,706,965 were applied for, the average compound bow incorporated a reduction of draw force at full draw in the 30–50% range. Compound bows having this level of letoff generally called for arrows having about 9 grains of arrow weight for each pound of bow draw weight. By 1994, the average compound bow incorporated a draw force reduction percentage in the 60–90% range. Some compound bows having higher levels of letoff built into their pulley systems were found to require only about 4–5 grains of arrow weight for each pound of bow draw weight, when the bow's limbs were constructed of lighter-weight laminates or pultruded materials than had been in use prior to 1985.

The requirements for longbows and recurves remain essentially unchanged from those described in U.S. Pat. No. 4,533,146, being about 6.5 grains of arrow weight per pound of bow draw weight for longbows, and 7.5 grains of arrow weight per pound of bow draw weight for recurve bows.

Additionally, a resurgence since 1985 in the use of overdraw accessories which allow a given bow to effectively use arrows that are 4–5" shorter than usual, also served to increase the relative stiffness of any given size shaft when it was cut off to a shorter length, providing a potential for even further reducing the total arrow weight of the arrows for bows equipped with overdraw arrow rest attachments.

Thus, prior to 1985, the total spread of arrow weight ranges for a given draw weight bow, regardless of whether the bow was of longbow, recurve, or compound bow design, would generally range between 6.5 grains of arrow weight for each pound of bow draw weight (for longbows with no letoff), to 9 grains of arrow weight per pound of bow draw weight (for compound bows with 30% letoff). Thus a 60# draw weight bow of any type could have it's matching arrow-weight requirements met by producing arrows whose total weight ranged from 390 grains to 540 grains, using the component mix defined by U.S. Pat. Nos. 4,533,146 and 4,706,965, with a variance of 150 grains in overall arrow weight. The variance of 150 grains in this instance represents a 52% increase of the heavier arrow's weight compared to the lighter arrow's weight.

By 1990, it had become the case that a compound bow of a given draw weight might require arrows with weight characteristics varying from 4.5 grains of arrow weight per pound of bow draw weight (for a short draw length compound bow having light mass weight limbs and having a reduction in draw force in the 80% range, coupled with use of an overdraw arrow rest attachment and very short arrows), up to 9 or more grains of arrow weight per pound of bow draw weight (for a compound bow having heavy mass weight limbs, and using full length arrows, and having a 25–30% letoff in draw force at full draw). The overall weight requirements for a given compound bow in the 60# draw weight range after 1990, might therefore vary from 270 grains up to 540 grains. The 270 grain variance in overall arrow weights in this instance represents a 100% increase of the heavier arrow's weight, when compared to the lighter arrow's weight.

The current greater spread of arrow weight requirements for a given draw weight of bows, of all bow types, effectively requires that between two different compound bows of equal draw weight, because of differences in limb mass and letoff characteristics, one bow might require an overall arrow weight that is two or more times as great as the other bow. Variances of this magnitude cannot be optimally accommodated by the prior art approaches described in U.S. Pat. Nos. 4,533,146 and 4,706,965, especially for hunting bows with relatively light draw weights.

Evolution in compound bows since 1985 has served to effectively negate much of the advantage relating to U.S. Pat. Nos. 4,533,146 and 4,706,965 which called for a single size arrow to be constructed for all different bow draw weights and draw lengths. Since 1985, evolutionary changes in compound bows have introduced an increased need for more than one size arrow to be produced so that every bow, regardless of type, limb mass, draw weight, draw length, and percentage of pulley system reduction in draw force at full draw, can achieve an optimum match of arrow mass (weight) to bow peak weight, and bow letoff.

From a practical standpoint, the changes to compound bows, especially since 1989, relating to increasing the level of draw force reduction at full draw by a significant amount, coupled with a resurgence in the use of overdraw attachments to the bow risers, and use of lighter mass materials in the bow's limbs, have again introduced such a significant difference between how stiff and heavy a shaft might need to be to be optimally fitted to a given bow, for the broader range of bow draw weight, draw length, limb mass, and draw force reduction (letoff) ranges now possible, that attempting to meet the needs of all bows with a single size shaft column became much more difficult, and increasingly less practical than had been the case earlier.

Given the evolutionary changes in bow configurations (overdraws) and increased letoff percentages built into many current-day compound bows, a single size shaft that would be stiff enough for all draw weights and draw lengths would often be heavier than necessary or desirable, even with the lightest of end-mounted components, when it comes to achieving an optimum arrow (weight) ratio for a given draw weight bow, especially low draw weight bows, having limbs constructed of light mass materials, and having pulley systems with high letoff percentages.

Conversely, an given size arrow that was light enough to be optimal when used from a very light draw weight bow, with a very high percentage of draw force reduction at full draw, and with short draw length, with the draw length possibly made even shorter by use of an overdraw, would often either be too limber for heavier draw-weight bows equipped with heavy mass limbs, and having a low letoff percentage, or not weigh enough to properly load the limbs sufficiently to preclude a dry-fire effect in the heavier draw weight bow.

At the time U.S. Pat. Nos. 4,533,146 and 4,706,195 were applied for, the single arrow for all sizes of bows, especially hunting bows, was a sound and practical concept. However, by 1990, continuing evolution in the compound bow area had significantly offset the usefulness of this aspect of these prior art references.

The other aspects of these prior art references remained in tact: those being the desirability of a means of additionally reinforcing the central section and the ends of the arrow shaft, and a means of providing a simple combination of standard size, but adjustable as to weight, components that could be mounted at either end of the shaft to build the proper front to back balance into the finished arrow. The approaches defined in U.S. Pat. Nos. 4,533,146 and 4,760,965 were adopted by several manufacturers of arrow shaft components.

At least one manufacturer continues to utilize a shaft design which incorporates thicker reinforcement cross sections and a larger outside diameter near the center of the shaft, though this manufacturer's shaft design does not include parallel outside surfaces, instead being somewhat barrel shaped. Several manufacturers now make integral nock/nock inserts, and points, and point inserts that provide trimmable tail sections suitable for varying their weight, and thereby adjusting the front-to-back balance in the completed arrow.

However, given that it is again necessary for arrows to be made in multiple sizes, in order to accommodate all bows in an optimum manner, much of the advantages involved in utilizing a combination of adjustable as to weight components has also been done away with, since each different size of arrow shaft must now have a complete set of adjustable as to weight components prepared for it.

When a single size arrow shaft could be produced to meet all bow requirements, a concurrent system utilizing a single (one size "set") of matching end-mounted components suitable for providing shaft-end reinforcements and adjusting front-to-back balance in the finished arrow, provided greater benefits than is now the case. This approach still works, but because multiple shaft sizes may now be required, this approach does not offer as great a benefit level as was intended at the time the invention was made.

The trimmable components defined in prior art reference U.S. Pat. No. 4,533,146 are somewhat more costly to produce than are fixed-weight components, and require additional labor (trimming) prior to assembly. Absent a corresponding single arrow shaft suitable for all bows, the greatest benefit of the trimmable, adjustable-as-to-weight, components is provided to arrow assemblers, who can produce more than one length and weight of finished arrow while maintaining fewer total components in their inventory. The advantages to the end users of the shafts made with trimmable-as-to-weight end components is negligible, assuming fixed weight components could be used to effect the same front-of-center balance in the finished arrow.

Further developments since 1985, in the evolution of hunting points, has also given rise to an understanding as to how the height of a given broadhead's blades may affect optimum front-to-back balance in hunting arrows, and how overall arrow velocity also may impact optimum arrow point selections.

While prior art references describe a preferred front to back balance point as being 10% in front of the shafts lengthwise center (for hunting arrows and excluding the point length itself), it is now known that arrows using broadhead arrow points whose blades stand higher than average (during flight to the target), require a somewhat greater percent-front-of-center balance point in the finished arrow, in order to offset the added turbulence and windplaning that accompanies higher standing blade edges. It should therefore be added to the prior art dissertations re: front-to-back balance in arrows used for hunting, that the ten percent front of center balance point may be the minimum percent front of center for hunting arrows, especially arrows outfitted with broadhead points having high standing blades attached to them.

It has also recently been shown that the faster an arrow is propelled from the bow, the lower the edges of hunting points should protrude from the point centerline, in order to effect optimum arrow flight. It should therefore also be added to the prior art dissertation re: front-to-back balance in arrows, that faster flying arrows, especially very light weight arrows, may need balance points more than ten percent front-of-center for optimum flight when hunting points are used.

Finally, it should be added to prior art dissertations relating to front-to-back balance in arrows that shorter, and lighter arrows which are more susceptible to deviation from point of aim due to wind gusts can often profit from a front-of-center balance point greater than ten percent of the shaft's length.

In summary, recent evolution in bows, especially compound bows having lighter mass limbs which accelerate arrows forward faster, and arrows now often optimally made lighter than prior art deemed desirable, and points, especially hunting points, have served to modify, to a measurable degree, the requirements regarding proper front-to-back balance in arrows, especially arrows equipped with hunting points.

Given the aforementioned evolutionary changes to bows arrows, and points, it can now be stated that, currently, the optimum balance point for a finished hunting arrow will lie at a point between ten and fifteen percent in front of the lengthwise center of the shaft (excluding the point), depending upon the overall length of the shaft, the weight of the shaft column itself, the speed the shaft is propelled forward at, and the height of the blades on the hunting points being used.

IV. SUMMARY OF THE INVENTION

It is an object of the present invention to provide an improved arrow shaft.

It is a further object of the invention to provide an arrow shaft, having substantially parallel outside surfaces, which incorporates in an integral manner additional reinforcements at each end of the shaft, and which eliminates the need to produce different weights of end-mounted components such as nock, nock insert, point, and point insert for different lengths of the same size shaft, in order to effect the desired front-to-back balance in the finished arrow, typically currently determined to be in the ten to fifteen percent front-of-center range, though other front-of-center balance point "ranges" are certainly accomplishable within the scope of the inventive arrow shaft.

It is a further object of the invention to provide an arrow shaft which has improved hoop strength.

In the event future evolution in compound bows and hunting points mandates further modifications to the optimum percent front-of-center balance point for arrow shafts, the general features of this invention including a method for providing, in an integral manner, improved front-to-balance point in arrows; and the method of this invention for providing, in an integral manner, the desired additional reinforcement in the shaft column at each end, and otherwise wherever additional columnar strength and hoop strength are needed, will continue to provide an optimum means of accomplishing both objectives.

According to a broad aspect of the invention, there is provided an arrow shaft having substantially parallel outside surfaces.

The shaft incorporates a core of porous and very lightweight material around which reinforcing materials are wrapped. The core material has a substantially round cross-section at all points along the length of the shaft, but not all sections of the core material have the same outside diameter. At each end of the shaft for a prescribed distance, the core material is reduced in diameter. One or more other sections of the core, intermediate the end sections, may likewise be reduced in diameter from other core sections intermediate the endmost sections of the core.

A combination of reinforcing materials running in the lengthwise direction for warp (lengthwise) strength, both compressive and tensile, and materials running helically around the core, for hoop strength, are wrapped around the core materials in such a manner that the resulting arrow shaft has substantially parallel outside surfaces along it's entire length. Those areas along the length of the shaft underneath which the core material itself was of reduced diameter incorporate greater thicknesses of reinforcement materials, so as to create an outside surface still having substantially parallel edges.

The reinforcement materials are selected to be heavier, and usually also much stronger, than the core materials. The result is an arrow shaft column that is not only substantially reinforced, from a strength standpoint, at each point along the length of the arrow shaft column that is underlaid by a core section of reduced diameter, but which is also heavier at the same points which are thus additionally reinforced.

It can be easily seen that by strategically selecting the specific areas, and lengths of each, to be additionally reinforced along the length of the shaft, that a composite shaft column can be produced which also achieves a prescribed front-to-back balance in it, such that a given single size and weight of nock insert, nock, point insert, and point, produces in the finished arrow the required front-to-back balance within a specified range, typically at the current point in time determined to be ten to fifteen percent in front of center, for all hunting arrow lengths, of the same given shaft size.

It can further easily be seen that by strategically selecting the positioning and lengths of the additional thicknesses of reinforcing materials along the length of the shaft column, including additionally reinforcing each end section of the shaft column, that the completed arrow can achieve both the desired strengthening at the ends of the shaft, and the desired front-to-back balance, when using a single fixed point weight and fixed point insert weight, for all lengths of the same shaft size, said reinforcements and front-to-back balance being achieved in an integral manner, with the additional reinforcements and front-of-center balance characteristics being integrated directly into the shaft column itself, rather than being achieved through use of either a variety of different fixed-weight assembly components, or a single set of adjustable-as-to-weight nock inserts, nocks, point inserts, and points, for a given shaft size.

The inventive method of providing the desired front-to-back balance point in the inventive arrow shaft by means of adding more weight and strength to the front part of the shaft, than to the back part of the shaft, provides an unexpected additional benefit aside from establishing the desired front-to-back balance point in the finished arrow while using non-adjustable-as-to-weight end components. The added benefit is the improved flight dynamics accomplished by spreading the additional front-of-center weight out over a longer length of the arrow shaft column itself.

Prior art methods of obtaining the desired front-of-center balance point in the overall arrow call for cementing in place a point insert to which a point is attached, or alternatively cementing in place a point in or over the end of the shaft column itself The point insert and point combine to achieve the desired amount of additional weight at the front end of the arrow, and may also provide some additional reinforcement to the front end of the arrow as well. Typically, the point insert, even when a trimmable-as-to-length insert is used, places the entire amount of combined point and point insert weight within an one to three inches of the endmost area of the front-end of the shaft column. Trimmable-as-to-length inserts and points also require a generally tubular shaft column for their mounting.

Prior art methods of producing the desired front-to-back balance, result in a finished arrow that has a considerably heavier combined point and point insert weight positioned at the very front-end of the shaft column, which causes the front-end of the arrow to drop down more rapidly than the back end of the arrow drops, once the apex of the trajectory curve is reached. The heavier the combined weights at the very front-end of the shaft column, when compared to the weights at the other end, and near the center of the shaft, the more rapidly the front-end of the arrow drops, when compared to the back-end of the arrow, after the apex of the trajectory curve is reached.

Conversely, the arrow shaft of this invention distributes more of the additional weight needed at the front of the arrow to effect proper front-to-back balance, along a substantially longer section of the front half of the shaft column itself, and uses a lighter combined weight point and point insert than would be called for with prior art shafts, in order to achieve the desired overall weight in the front half of the arrow.

The inventive shaft therefore provides, as an added benefit, a means of improving the resultant arrow trajectory curve, for a given overall weight of arrow, having a given front-to-back balance percentage, by reducing the tendency of the arrow to nose over, and "dive" more rapidly toward the ground, after the peak of the trajectory curve has been reached.

The inventive arrow shaft produces another benefit aside improving the trajectory potential derived from spreading the desired additional front-of-center weight out over a longer length of the shaft column. The providing of additional weight in the front part of the shaft column itself, means that a lighter weight point, and/or point insert is needed to effect the proper overall front-to-back balance in the finished arrow.

The lighter combined point and point insert weights called for when using the arrow shafts of this invention provide a lower total amount of fixed inertia mass, related to front end components mounted at the very front end of the arrow, that has to be overcome during acceleration. The reduced point and point insert weights called for in the inventive arrow shaft, in turn allows somewhat less stiffness to be built into in the central area of the shaft column while still maintaining a shaft column that is suitably stiff so as to avoid excessively buckling when being accelerated out of the bow. The reduced stiffness requirements in the central section of the shaft column, in order to accommodate lighter point weights, while still maintaining optimum front-to-back balance in the overall arrow, will generally allow shafts of a given size to be made somewhat lighter, when constructed of a given compliment of composite materials.

More important however is, that by providing a solution that achieves the sought after benefits relating to front-to-back balance in the overall arrow, the reduced point weights called for when employing the inventive arrow shaft, serves to significantly reduce bending moments imparted to the center section of the shaft during the acceleration period, and thereby serves to improve accuracy and arrow flight stability as well over prior art approaches, while using less reinforcement materials of a given type near the center of the shaft column than would be required with prior art approaches.

The inventive arrow shaft is neither a truly tubular design or a solid design. It incorporates the best features of both of these prior art shaft types. The central core of the shaft, made of very lightweight and porous materials, is used as a mandrel during the lay-up process. The core mandrel is thereafter left in the arrow shaft and not removed. This aspect of the invention serves to greatly simplify the manufacturing process. Prior art approaches to constructing composite arrow shafts have required that polished mandrels be used during the curing cycle. Removal of mandrels is a time consuming process, and therefore adds to the cost to produce tubular composite shafts. Mandrel-based arrow shaft manufacturing operations involving composite construction methods also require that mandrels be frequently "stripped" (cleaned) with a caustic agent, which over time erodes the mandrels and forces mandrel replacement. The manufacturing process for producing the inventive shaft avoids all of these mandrel-related operations and costs.

Because the core incorporates larger outside diameter sections intermediate the ends of the shaft column, the core material is effectively mechanically locked into place, as well as having an adhesive bond between the core materials and the outer reinforcing materials, and the core is thereby made doubly inseparable from the outside reinforcement materials.

The feature of the inventive arrow shaft calling for a core section to be comprised of sections having different diameters at different points along the length of the arrow shaft column, circumvents problems encountered by producers of composite shafts which are comprised of tubes having parallel outside surfaces which serve as a non-porous mandrel during manufacturing operations, overlaid with, and cemented to, fiber reinforcement materials, resulting in the "barrel shaped" shafts alluded to earlier. In these prior art shafts, a breakdown in the bond between the non-porous, parallel-outside-surfaced, mandrel material (typically aluminum) and the overlaying fiber reinforcement materials (typically graphite), sometimes allows the inner "mandrel" section to separate from, and slip out of, the outer fiber reinforcement layers during acceleration and/or impact, thereby rendering the arrow useless from that point in time forward.

In a preferred embodiment of the inventive arrow shaft, the diameter of the core material at the ends of the shaft column are selected to be the same as the diameter(s) of the male section(s) of the nock and/or point insert that will be used in the finished arrow. The core material is removed (drilled out) a sufficient distance to allow the nock/nock insert and point/point insert to be fitted into each end of the shaft. The inserts are thus cemented not to the core material, but to the outside reinforcement materials at each end of the shaft. In prior art composite shafts which left the tubular "mandrel" in the shaft after adding reinforcement materials, the nock and point inserts were cemented directly to the inside tube surface of the mandrel, rather than to the outside reinforcing materials. Thus, when the adhesive bond between the mandrel and outside reinforcing materials broke down, the point and mandrel were both free to disengage completely from the outer reinforcement materials.

The inventive arrow shaft does not rely totally on the adhesive bond between the core materials and the outer reinforcing materials to keep the core materials in place during acceleration, impact, or at any other time. The mechanical lock provided by the larger outside diameter core sections intermediate the ends of the shaft column precludes movement of the core regardless of the strength of the adhesive bond between the core and outside reinforcing materials.

However, it is also the case that by selecting the core to be made of a porous material, that the adhesive bond between the core of the inventive arrow shaft, and the outside reinforcing materials in the inventive arrow shaft, will be more reliable than the adhesive bonds achieved in prior art composite shafts alluded to earlier, which employed non-porous mandrels overlaid by reinforcements, resulting in a shaft column having a somewhat barrel-shaped outside surface. The cementing of the nock and point inserts directly to the outer reinforcing material layers provides a third locking mechanism for precluding movement of the core materials at any point in time.

Retaining the core material, mechanically locked in place and cemented to the outside reinforcement materials, provides significant stiffening in the overall shaft column. The improved sectional density of the composite column, combines with greater reinforcement stiffness in a manner that produces further additional benefits in terms of enhancing the penetration potential of the arrow, enhancing accuracy, and quieting the downrange flight of the arrow. The added stiffness obtained by retention of the inner core material, coupled with the additionally reinforced front end of the shaft column, aids the shaft column in staying straight at the time of impact, and serves to maximize the amount of kinetic energy in the column that is concentrated in a single direction at the time of impact, thereby enhancing the penetration potential of arrows made using shafts of this invention.

The added stiffness, and the manner in which the core materials are joined to the outer reinforcement materials such that bending moments affecting any point along the shaft's length are both offset by materials on the opposite side of the shaft column, and by the underlying core materials, serves to dampen any harmonic vibrations imparted to the shaft column during acceleration, and thereby serves to restore stability more quickly, which positively impacts shooting accuracy, and also serves to reduce noise relating to harmonic vibrations in the shaft when such vibrations are present.

The inventive method of shaft construction yields another benefit not present in prior art composite shafts. The retention of the core materials serves to significantly improve the hoop strength of the shaft column at all points along it's length. Improved hoop strength serves to improve durability in the arrow when it comes in contact with sudden pressure coming against the side of the column, such as when a misdirected arrow inadvertently "skips" off of a log, tree branch, or rock.

V. BRIEF DESCRIPTION OF THE DRAWINGS

FIG. #1. is a side view of a solid core section as described in the preferred embodiment of the inventive arrow shaft.

FIG. #2. is a side view of an alternative core section, different from FIG. #1 only in that the core section in this figure incorporates a lengthwise tubular hole at it's center, thereby making it lighter by some measure than would be a solid core as shown in FIG. #1 comprised of identical materials and which had identical outside measurements at all points along the length of core material.

FIG. #3. is a cut-away lengthwise cross-section of a core section of the preferred embodiment, overlaid with varying thicknesses of lengthwise and helical reinforcing materials such that the outside surfaces of the shaft are substantially parallel at all points along it's length.

Figure 2:
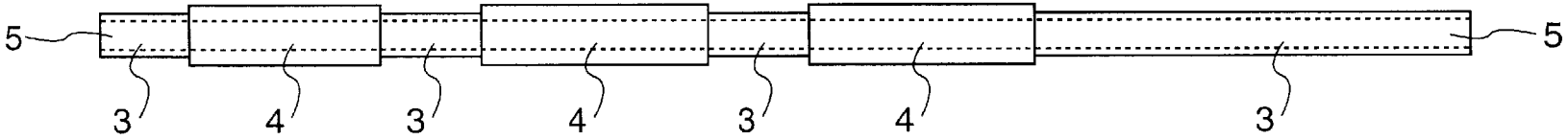
Figure 3:
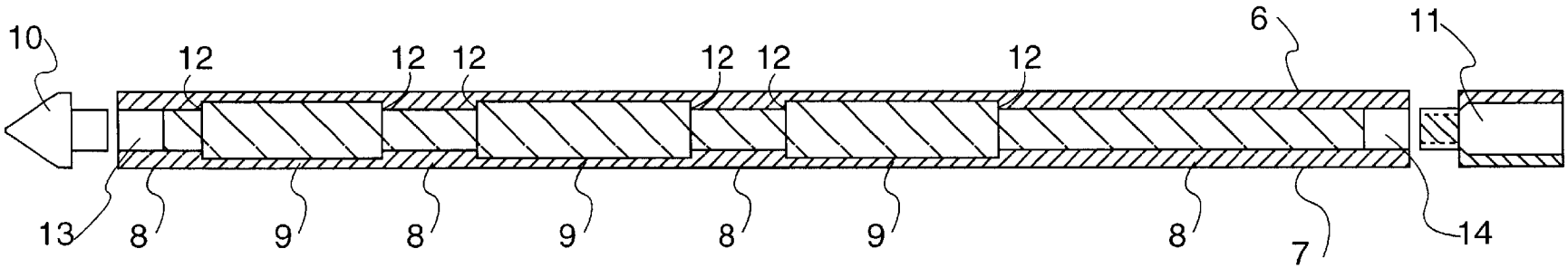

FIGS. 1, 2, and 3 have been laid out one over the other, in a columnar fashion, so that common lengthwise dimensional measurements relating to each may be easily viewed in a graphical manner.

FIG. #4. is an end-cross-sectional view of the endmost sections of the inventive shaft. This view shows the reinforcing material lay-up around the smaller outside diameter core materials at each end of the inventive shaft column.

FIG. #5. is an end-cross-sectional view of the intermediate sections of the inventive arrow shaft, located between the endmost sections, wherein the underlying core materials have larger outside diameters than do the core sections at the ends of the shaft columns.

FIGS. #4 and #5, have been placed side by side to allow dimensional differences relating to varying thicknesses of reinforcement and different outside diameters of core materials at different points along the shaft column to be rendered easily apparent to the viewer.

FIG. #6. graphically depicts a simple eight step, non-capital-intensive, method for producing the inventive arrow shafts.

FIG. #7*a*. illustrates how layers of reinforcing materials running in different directions are oriented with respect to one another when overlaying both the smaller-outside-diameter core sections, and the larger-outside-diameter core sections, in the preferred embodiment.

FIG. #7*b*. is a table depicting what the thicknesses of different layers shown in the illustrations might be, for a series of a limited number of arrow sizes described in the preferred embodiment.

VI. DESCRIPTION OF THE PREFERRED EMBODIMENT

The preferred embodiment relates to an arrow shaft of a given size being constructed for use with hunting points, and which will, when incorporated into the construction of a finished arrow, effectively allow the utilization of a single set of fixed-weight, end-mounted components suitable for outfitting hunting arrows, for arrows of the given size of all lengths between 24" and 34". The preferred embodiment defines an arrow shaft that, when used to construct a finished hunting arrow, will yield a balance point that is within ten to fifteen percent in front of center when assembled with a single fixed-weight set of end-mounted components, when the given size arrow shaft is cut to any finished length between 24" and 34". The arrow shafts described in the preferred embodiment include features which, with minor modifications that would be obvious to one skilled in the art, would yield arrows suitable for other types of archery shooting as well.

FIG. 1 shows a side view of a solid, substantially round core component relating to the preferred embodiment of inventive arrow shaft. The core section has back end (1), and a front end (2). The core section has four sections of reduced diameter (3), and three sections of larger diameter (4). FIG. 1 further reveals what is believed to be an optimum placement and length of each core section when building arrows for hunting use, with smaller diameter sections (3) being shown to be approximately 2", 2", 2", and 14" long, and larger diameter core sections (4) being 4", 5", and 5" in length. The overall length of the core is 34". The core is designed to provide the sought after benefits in hunting arrows ranging in length between 24" and 34".

In the preferred embodiment, the 24" minimum length was selected as a representative minimum length suitable for hand held hunting bows. Several states now have prohibitions against use of arrows shorter than 26" when used for hunting with hand-held bows. The 34" maximum length was selected as a representative maximum length, since, as a practical matter, most archers having draw lengths longer than 34" choose to use overdraws and arrows shorter than 34" in length as a means of reducing arrow weights, and enhancing arrow velocities by use of the shorter arrows.

It will be seen that by varying the positioning and length of the core sections having smaller diameters, when compared to the positioning and length of the core sections having greater diameters, that arrows configured so as to provide, in a single given shaft column, a method of obtaining arrows both shorter than 24" and longer than 34", while still meeting all of the goals of the invention, could be constructed using the teachings of this invention. The selection of the length range between 24" and 34" has been selected solely as representative of the range of typical lengths of hunting arrows at the time the invention was made, and therefore as most useful in describing the preferred embodiment of the invention.

FIG. 2 illustrates a side view of a similar core section, differing from the core section in FIG. 1, only in that the core section in FIG. 2 embodies a lengthwise hole (5) throughout it's entire length. The lengthwise hole would serve to lighten the overall weight of the core when constructed of a given material type.

Either a variable-outside-diameter solid core, or a variable-outside-diameter core having a lengthwise center hole, would work well in the inventive arrow shaft. The core material is selected to be a very light weight material. Balsa wood, syntactic foam, or other similarly light-in-weight natural or synthetic materials would serve for this purpose.

FIG. 3 is a cross-sectional, side-view of the core shown in FIG. 1, overlaid by reinforcing materials along it's entire length. The finished arrow shaft column is shown to have substantially parallel outside surfaces (6) and (7), along it's entire length when all reinforcing materials are in place over the variable-outside-diameter core sections. Those distances along the length of the shaft column that are underlaid by a section of core material having smaller outside diameters (8), are shown to have increased thicknesses of overlaying reinforcement materials. Those distances along the length of the shaft column that are underlaid by a section of core material having larger outside diameters (9), are shown to have a thinner overlaying thickness of reinforcing materials.

During assembly of the shaft into a finished arrow, the back end of the arrow shaft has core material removed (13) suitable for accepting a fixed weight and length nock insert (10). During assembly of the shaft into a finished arrow, the front end of the arrow shaft has core material removed (14) suitable for accepting a point or point insert component (11). The larger diameter core sections and intermediate smaller diameter core segments are cemented with adhesives to the surrounding reinforcement materials and are further effectively mechanically locked into position at a number of points (12) along the length of the shaft. The end sections of smaller diameter core materials are cemented with adhesives to the surrounding reinforcement materials and are further mechanically locked into place by the cementing in place of the nock insert (10) and point insert (11) components to the reinforcing materials at each end of the shaft column.

The reinforcement materials overlaying the core are selected to have greater mass than do the core materials, and generally to be much stronger as well. Materials which work especially well for these purposes are boron and graphite, though other materials can also be used for these purposes in shafts of this invention Boron has significantly higher strength both in compression and under tension than do most other materials suitable for constructing arrow shaft columns, and is very light in weight. The use of boron for the lengthwise reinforcement fibers generally serves to achieve the greatest possible stiffening in the warp (lengthwise) direction, while keeping the overall weight of the shaft column to a minimum. The preferred embodiment employs materials like boron or high modulus graphite running in the warp (lengthwise) direction to effect the optimum ratio of strength to weight in the warp direction in the shaft column.

The preferred embodiment also provides that each layer of lengthwise reinforcing materials be both underlaid and overlaid with a layer of hoop strength materials wound in a helical manner around the shaft core and/or column. This is not a requirement of the invention insofar as accomplishing front-of-center balance in the shaft column and finished arrow, but is felt to be the preferred approach, since including high strength reinforcing fibers, wrapped helically around the shaft column, adds substantially to the hoop strength of the column, and further serves to contain warp fibers that could otherwise, upon impact with generally unintended hard surfaces (like rocks), more easily separate in a manner that allowed the warp fibers to separate from their surrounding matrix adhesives and splay out, causing irreparable shaft damage.

Pre-impregnated columnar tapes comprised of graphite reinforcing fibers set in a matrix resin are felt to be an optimum choice for hoop strength materials. Being somewhat less stiff than boron, the graphite tapes can be wrapped around smaller diameters than boron, and boron and graphite have similar coefficients of thermal expansion, making them well suited for joining with matrix-based adhesive systems.

It can easily be seen that by selecting the reinforcing materials to have greater mass than the underlying core materials, that the smaller core diameter sections of the shaft column will be relatively heavier than the larger core diameter sections. By selecting the positioning and length of smaller core diameter sections as shown in FIG. 1, FIG. 2, and FIG. 3, it will be the case that no matter what length between 24" and 34" the shaft is cut off at for a given shooter, the front ½ of the arrow shaft will weigh more than the back ½ of the arrow shaft.

For example: as shown in FIG. 1, the back half of a 24" arrow shaft would have 4" of length with smaller underlying core and greater thickness of reinforcing materials, and 8" of length with a larger underlying core and thinner thickness of overlaying reinforcing materials. The front end of the 24" shaft would incorporate 6" of length with underlying smaller diameter core and greater reinforcement thickness, and only 6" of underlying larger diameter core overlaid by a thinner thickness of reinforcing materials. The front half of the arrow shaft would therefore weigh more than the back half by some margin.

At the other end of the length spectrum, given the same shaft used in the preceding paragraph being cut to a finished length of 34", the back ½ of the arrow shaft would be made up of 6" of length wherein the underlying core material was of smaller diameter and was overlaid with a greater thickness of reinforcing material, and 11" of length wherein the underlying core material was of larger diameter and was overlaid with a lesser thickness of reinforcing material; while the front ½ of the shaft would be comprised of 14" of length wherein the underlying core material was of smaller diameter overlaid by a greater thickness of reinforcing material, and only 3" of length wherein the underlying core material was of larger diameter overlaid by a lesser thickness of reinforcing material. The front half of the 34" arrow shaft would therefore weigh even proportionally more than the back half, when compared to the shaft that was cut to a finished length of 24".

Since the need for increased weight in the front half of the arrow grows inapproximately a linear proportion to the overall length of the shaft, the method of this invention, used to effect proper front-to-back balance in the finished arrow works with a given single fixed weight set of end-mounted components including point, point insert, nock, nock insert, and fletching.

In shafts of the invention cut to shorter lengths, relatively more of the total amount of weight needed in the front half of the finished arrow to effect a proper front-of-center balance point is achieved by adding (the same total amount of) point and point insert related weights, and relatively less by virtue of the increased mass in the front half of the shaft column itself. In shafts of the invention cut to longer lengths, relatively less of the total weight needed in the front half of the finished arrow to effect a proper front-of-center balance point is achieved by adding (the same total amount of) point and point insert weights, and relatively more by virtue of the added mass of the shaft column itself in the front half of the arrow.

The inventive arrow shaft provides greater strength at each end of the shaft integrated into the shaft itself, by virtue of the increased thicknesses of reinforcing materials in these sections.

The inventive arrow shaft provides improved flight trajectories due to the more efficient distribution of front-of-center weights by integrating into the shaft column itself more of the front-of-center weight needed, and by spreading the total amount of the front-of-center weight needed along a more substantial length of the front of the shaft column than prior art approaches.

The preferred embodiment of the inventive shaft column is "sectioned" internally, somewhat like bamboo stalks, in that multiple different points intermediate the ends of the shaft column are additionally reinforced underneath the outside surface of the shaft. The "sectioning" of the shaft column in this manner, serves to divide the entire length of the shaft into a series of short, and taken individually, very stiff, sections, any one of which, taken by itself, would be almost rigid. Even those sections of the shaft that are underlaid by a larger diameter core, and which therefore have thinner overlaying thicknesses of reinforcing materials, are made relatively much stiffer by this method, when compared to a tubular configuration wherein the same outside diameter was underlaid by the same thickness of reinforcing materials as used in the inventive arrow shaft (over the larger-diameter core sections), for the entire length of the comparative tubular shaft column.

The inventive arrow shaft construction results in a series of very short individual sections, each of which has a very short bending or flexing moment associated with it, in such a manner that each such short section is substantially constrained from bending by itself The whole of the arrow shaft column is equal to the sum of it's individual sections, and the resultant shaft achieves the maximum in stiffness over it's entire length, while employing less reinforcement materials of a given type, in the intermediate sections, then would be achievable with prior art approaches. The sections of the shaft having smaller underlying core diameters would be the stiffest, of course, but by providing "sections" of the shaft of different underlying diameters of core materials, every section of the shaft, having the same finished outside diameter, is significantly reduced in relative flexural length, and correspondingly increased in relative stiffness.

The fewest number of different-diameter, adjoining core sections possible in shafts of the invention, patterned after the preferred embodiment, is three. An alternate embodiment could use as few as two. A shaft made with the fewest number of different diameter adjoining core sections in the preferred embodiment would have one smaller diameter core section at each outside end of the shaft, adjoined to a single larger diameter core section between them. The preferred embodiment configuration with the fewest number of different-outside-diameter, adjoining core segments (three) would, however, require a relatively somewhat greater thickness of stiffening reinforcing materials over the entire length of the center core section, and therefore of the overall shaft length, than would be required if one or more additional short, smaller-diameter-core sections were placed intermediate the smaller-diameter-core sections at the very ends of the shaft column.

The inventive arrow shaft can be made with less reinforcement materials overall in it's intermediate section(s) than required by prior art approaches, due to the "sectioning" aspect which effectively divides the overall length of the shaft column into a series of relatively short and relatively stiffer sub-sections, and still incorporates sufficient intermediate columnar strength to avoid buckling when propelled rapidly from the rear, or when impacting the intended target, and, at the same time, incorporates in an integral manner the necessary additional front-end and back-end reinforcement to minimize damage in these areas, and can concurrently be configured so as to effect, with a given, single, fixed-weight set of end-mounted components, the proper front-of-center balance in the finished arrow for arrows of all lengths, due to a significant measure of the additional front-of-center weight needed in the arrow, being integrated directly into the front-end half of the shaft column itself.

In the preferred embodiment, the core materials are affixed to the overlaying reinforcing materials with adhesive compounds, as well as being mechanically locked into position at each point where the diameter of the inner core materials changes. The core therefore serves to further improve hoop strength in the arrow when sudden pressure is applied from the side, as when a misdirected shot results in the arrow "skipping" off of a tree limb or rock, before coming to rest.

Figure 4:
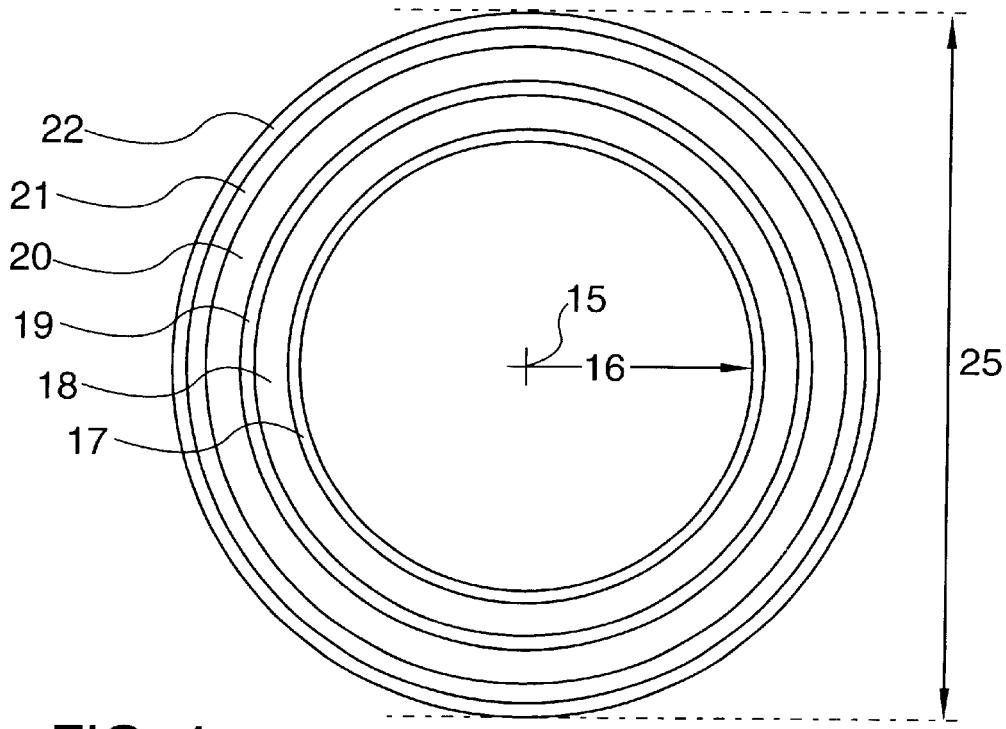

FIG. 4 is a cross-sectional view from the end of a preferred lay-up of reinforcing materials over the core sections that are the smaller in diameter. FIG. 4 corresponds to the smaller diameter core segments of the core shown as (3) in FIG. 1 and FIG. 2, and also corresponds to smaller diameter core segments shown as (8) in FIG. 3. The center of the core section is indicated by (15), and the radius of the smaller-diameter core segment is shown as (16).

A weft-directional, hoop-strength layer of reinforcing material (17) is wrapped in a helical fashion around the core material as the first layer in a multi-layer configuration. A layer, or layers, of warp-directional, lengthwise-strength, reinforcement materials (18) having reinforcement fibers running parallel to the lengthwise axis of the core is placed over the initial hoop strength layer of reinforcing materials.

The term warp is intended when used herein, as used in braiding technology, to indicate reinforcing fibers running generally in the lengthwise direction of the part. The term weft, when used herein is intended, as used in braiding technology, to indicate reinforcing materials running at an angle, usually at 90 degrees, plus 45 degrees, or minus 45 degrees, to the warp materials. The total reinforcement thickness overlaying the smaller diameter core sections at this point, when added to the radius (16) of the smaller diameter core sections, is sufficient to create a circular cross section having a radius equal to the larger diameter core segments, shown as (24) in FIG. 5. That is, in FIG. 4, radius (16) when added to the thicknesses of layers (17) and (18) will be equivalent to the length of the larger core radius (24) in FIG. 5.

Figure 5:
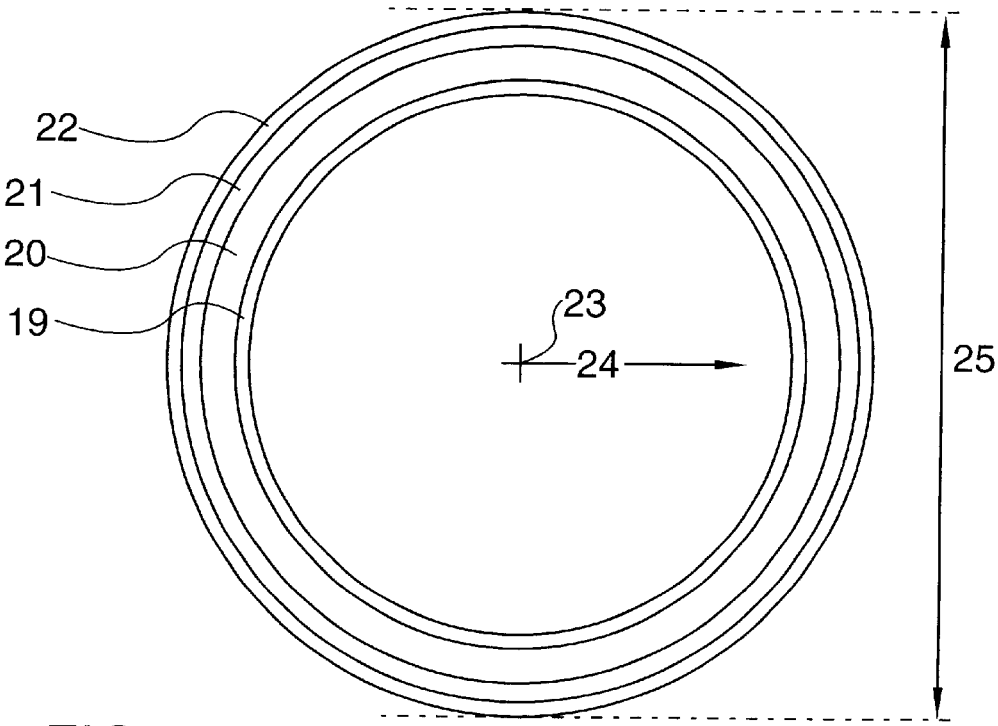

FIG. 5 illustrates a cross-sectional view from the end of a preferred lay-up of reinforcing materials over the larger diameter core sections. FIG. 5 corresponds to larger diameter core segments shown as (4) in FIG. 1 and FIG. 2, and also corresponds to larger diameter core segments shown as (9) in FIG. 3. The larger diameter core section is shown to be substantially round and to have a center (23) and radius (24). FIG. 4 and FIG. 5 have been placed one above the other to illustrate the relative thicknesses of reinforcing materials, and how each layer of fiber reinforcements, running in different directions, is placed in the preferred embodiment.

The radius of the larger core diameter sections ((24), FIG. 5) is set to be substantially equal to the radius of the smaller core section ((16), FIG. 4) plus the combined thicknesses of the first two layers of reinforcement materials ((17), FIG. 4) and ((18), FIG. 4).

After reinforcement layers (17) and (18) have been placed around the smaller diameter core sections, the entire shaft column length is wrapped with a second layer, of hoop-strength reinforcing materials (19). A second layer, or layers, of warp-strength reinforcing materials (20) is placed over the hoop-strength layer shown as (19), for the entire length of the shaft column. Two more hoop-strength layers (21) and (22) are wrapped in a helical manner around the topmost warp-strength reinforcement material layer (20), for the entire length of the shaft column, with one of said helical wraps placed at approximately +45 degrees to the lengthwise axis of the shaft, and the other of said helical wraps placed at approximately −45 degrees to the lengthwise axis of the shaft column. All layers of reinforcement materials (19), (20), (21), and (22) apply to both FIG. 4 and FIG. 5.

As shown in FIG. 4 and FIG. 5, each layer of warp-strength reinforcement material having fibers running in the lengthwise direction (18) and (20), is both underlaid and overlaid by one or more layers of weft (hoop) strength reinforcement materials having fibers running in a helical manner around the shaft column. The weft fibers (19), (21), and (22) are wrapped in a helical manner in continuous fashion from one end of the shaft to the other. These helical wrappings serve to stabilize the lengthwise material fibers (18) and (20) placed between them, and will additionally serve to significantly increase hoop strength in the column at all points along the length of the shaft when fixed in place with adhesives.

It can readily be seen that the combined thickness of material reinforcements (17) and (18) can be adjusted to effect, when combined with a strategic selection of the placement and lengths of the smaller underlying core segments, the desired ratio of heavier sections and lighter sections along the length of the overall shaft column. The combined thicknesses and weights of layers (17) and (18) of a given material type or types, serves as the method for adjusting the ratio of front to back balance in the shaft column when used with a given fixed-weight set of end-mounted components.

Similarly, in FIG. 4, the combined thicknesses and weights of layers (19), (20), (21), and (22) serve to provide for adjusting the overall weight, hoop strength, and overall stiffness of the finished shaft column.

Further, the ratio between the combined thicknesses of materials in layers (17) and (18) of FIG. 4, when compared to the total thickness of all layers of reinforcing materials covering the smaller core sections (layers (17) through (22), inclusive), is the principal determining factor as to precisely which single point weight(s) will achieve the desired front-of-center balance point in the arrow. When the combined thickness of layers (17) and (18), inclusive, represents a greater percentage of the combined thicknesses of layers (17) through (22), inclusive, the required point weight will be less than when the combined thickness of layers (17) and (18), inclusive, represents a smaller percentage of the combined thicknesses of layers (17) through (22), inclusive. More detail regarding this aspect of the invention will be reflected in the section entitled "additional enabling information", following this section.

In FIG. 4, Any of the layers shown (17) through (22) may be constructed of either a single thickness of reinforcing material or may be comprised of several wraps of thin material equaling the desired overall thickness. The preferred embodiment's approach employs one or more layers, of a given single thickness, of material of the desired thickness for each hoop-strength layer (17), (19), (21), and (22), and multiple thin layers of material equaling the desired overall thickness for the layers of warp-strength materials (18) and (20).

The preferred hoop strength materials, like pre-impregnated columnar graphite tapes, can generally be purchased in any thickness from 0.002" to 0.025", whereas columnar tapes using boron as the reinforcement material are presently only available in thicknesses of approximately 0.004". It is a simple matter to adjust warp-strength layers (18) and/or (20), by using multiple wraps of thin columnar preimpregnated tapes of boron and/or graphite, to achieve the overall desired thickness and weight needed at each point, and along each sub-section of the overall shaft column.

Figure 6:
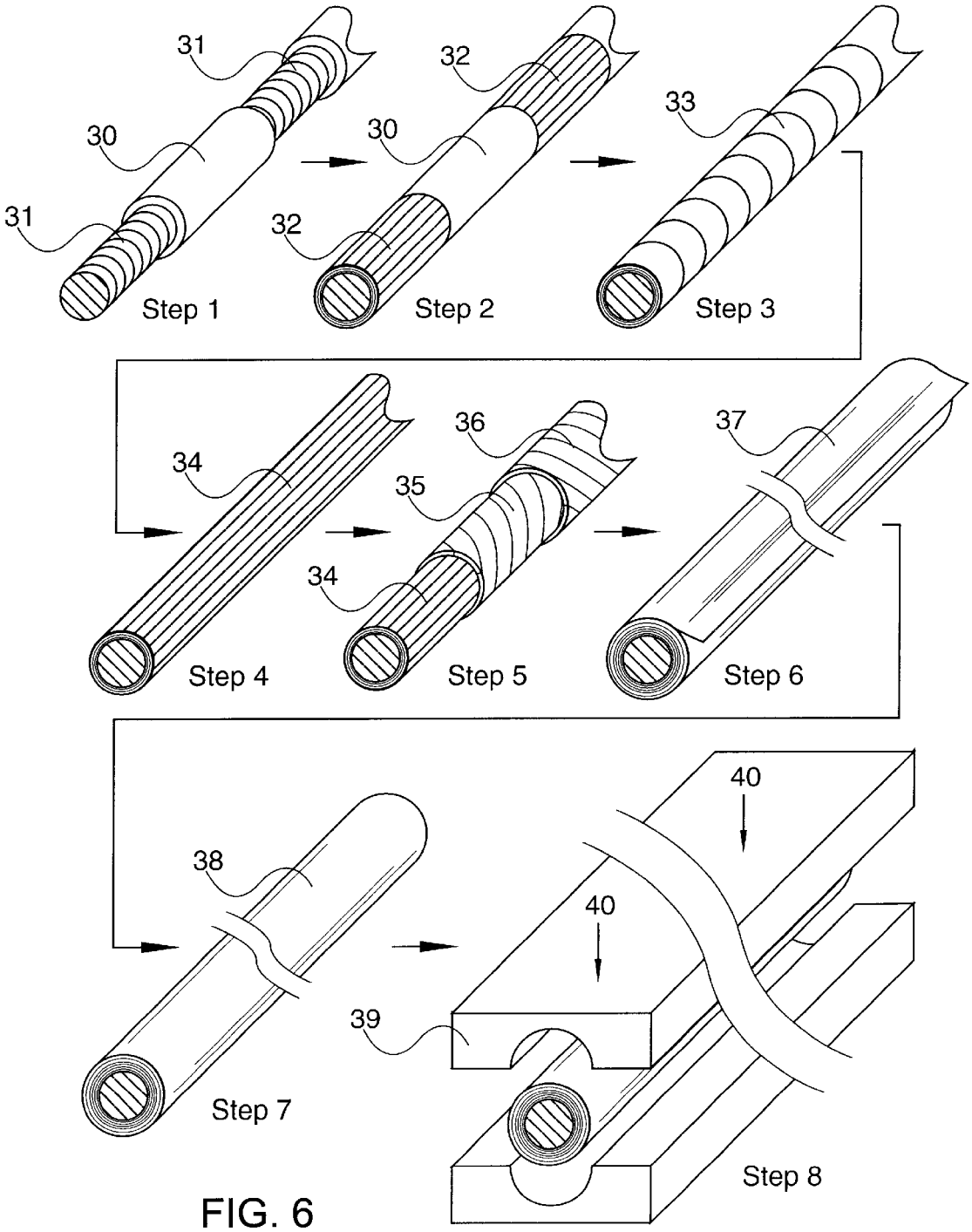

FIG. 6 shows graphically, using a series of views of the shaft column as viewed from above and to the right, during the lay-up process, how the material lay-ups shown in FIG. 4 and FIG. 5 from an end-cross-sectional view, would appear.

Step 1 in FIG. 6 shows core material with larger diameter sections (30) and smaller diameter sections (31). Step 2 shows smaller diameter sections overwrapped with warp strength materials (32) to a level equal to the (bare) larger diameter core sections (30). Step 3 shows an overwrapped layer of weft material (33) wrapped along the entire length of the shaft at an approximate 45 degree angle with respect to the lengthwise axis of the shaft. Step 4 shows the entire length of the shaft column again overlaid with one or more wraps of warp strength material (34). Step 5 shows the overwrapping of the shaft again for it's entire length with a layer of weft strength material (35) at approximately plus 45 degrees to the lengthwise axis if the shaft, and a second overwrapping of the entire length of the shaft column with weft strength material (36) at approximately minus 45 degrees to the lengthwise axis of the shaft. Step 6 in FIG. 6 shows the shaft column having all reinforcement materials wrapped in place prior to beginning the curing process. All reinforcement materials in the preferred embodiment are selected to be columnar tapes having either boron or high-modulus graphite as reinforcement materials embedded in a matrix resin, usually epoxy-based. Step 6 shows an additional wrapping of epoxy-based or polyester-based gel coating material (37) being wrapped around the shaft column for it's entire length. The purpose of the gel-coat material is to provide a smooth outer surface after curing, and to provide a means of producing shafts having different colors. Step 7, shown in FIG. 6, shows the overwrapping of the gel-coat materials with a sleeve of Teflon-based shrink wrapping material (38). The shrink wrap serves to hold the gel-coat and other wrappings in place during the time between when the lay-up is completed, and the point in time when the overwrapped core is ready to be placed in the curing environment. Step 8, shown in FIG. 6, shows the preferred method for building adequate straightness into the finished shaft. Each overwrapped core, as shown in Step 7 of FIG. 6, is placed in a mold cavity during the period of time when heat and pressure (40) is being applied to act as a catalyst for curing the preimpregnated adhesives in the columnar tapes used as reinforcement materials.

The mold is placed under a suitable amount of pressure (40) from the top and bottom during the curing period. The pressure may be mechanically applied or induced by use of an autoclave. The use of a mold during the curing process circumvents lack of straightness problems typically encountered when unidirectional pultruded materials are employed in constructing fiber-reinforced tubes suitable for use as arrow shafts.

Molds may constructed with end-to-end straightness of 0.0005". Any degree of straightness better than 0.010" is probably suitable for arrow shafts, with a 0.010" degree of straightness being straighter than the archers ability will be able to take advantage of However, it is an advantage of the manufacturing process here recommended for use in constructing the inventive arrow shafts, that the level of straightness that can be assured in every shaft of the invention, will be straighter than prior art shafts can be made on a consistent basis, by either pultrusion or by drawing tubes over a mandrel.

The shaft will optimally be left in the mold cavity, under pressure, while the cavity cools to room temperature, in order to preclude the occurrence of material creep during the cooling period. Once removed from the mold, shafts will be centerless ground to remove the shrink tubing material, and to remove any mold flashing line left in the gel-coat material. The final steps in the manufacturing process will be removal of a sufficient amount of core material at each end to provide for accepting the nock insert and point insert when the shaft is assembled into a finished arrow.

VI. Additional Enabling Information

A stated in the preceding section, there are many different configurations possible within the general parameters of the invention. The fewest number of differing-size-diameter, adjoining core sections in shafts defined by the preferred embodiment is three, comprised of a smaller diameter core section at each end of the shaft, separated by a single larger diameter core section between them. The three-segment version is practical, and can be configured in a manner that provides for meeting all of the goals of the invention. Additionally a weight-forward version could be made utilizing only two different core diameters, a larger diameter core-segment in the back portion of the shaft column, and a smaller diameter core-segment in the front portion of the shaft column.

However the two-core-segment version would have to rely entirely on adhesive action between core materials and reinforcing materials to preclude core slippage toward the rear of the shaft, in the event adhesives joining the core materials and overlaying reinforcing materials failed. The two core section version would additionally have to rely to a greater degree on the strength of the nock insert in the shaft to provide additional strength at the rear of the shaft column. Therefore, while practical and possible within the scope of the invention, neither the two-core-segment or three-core-segment versions of the invention are considered to be the preferred embodiment for hunting arrows.

For arrow shafts to be used in hunting arrows, it is believed that the preferred embodiment should include at least one to two additional smaller diameter core segments intermediate the endmost smaller diameter core segments, as shown in FIG. 1. Multiple smaller diameter core sections of short length, positioned intermediate the two endmost smaller diameter core segments, are felt to provide a superior means of effecting a somewhat better overall (columnar) strength-to-weight ratio in the central section of the shaft, while using less reinforcement materials in the intermediate sections of the shaft column than would be required in a three-core-segment version or two-core-segment version.

While it has become less practical to attempt to provide a single size "universal" arrow shaft for all bows, for all the reasons previously stated, it is still desirable to provide for meeting the needs of all bows with as few a number of different shaft sizes as possible. Further, it is certainly possible using teachings of this invention to provide other core configurations that are workable within the framework of the invention, by selecting different numbers of differing-diameter, adjoining core sections, varying the diameter differences between adjoining core segments, and by varying the positioning and lengths of each different-diameter core section. The vast number of possibilities possible within the overall framework of the invention is, in fact, a general benefit of the invention.

However, in order to aid first time users of the invention, the following method of configuring a series of five different size shafts suitable for hunting bows is offered. The same principles can be used by those skilled in the art to effect any number of other sizes, outside diameters, overall finished arrow weights, choices of combinations of materials, and variables within the general framework defined by the invention as noted above, and as further elaborated on in this section.

Figure 7A:
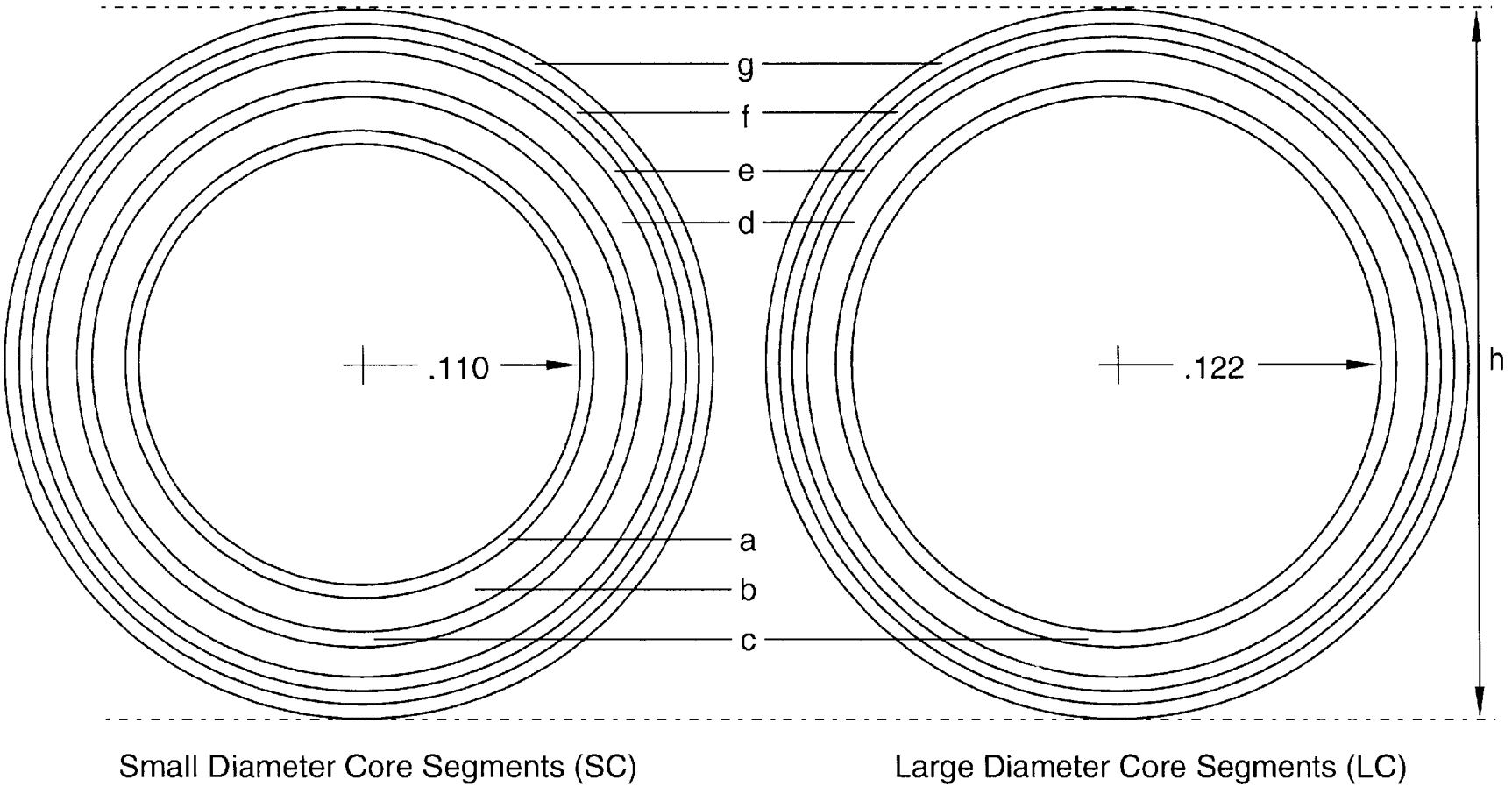

FIG. 7*a* again shows cross-sectional end views of smaller diameter core segments and larger-diameter core segments overlaid by various layers of reinforcing materials, similar to the end-view, cross-sectional depictions in FIG. 4 and FIG. 5. However in FIG. 7*a*, core-radius dimensions of 0.110" for the smaller-diameter core sections and 0.122" for the larger-diameter core sections have been added to the drawings, and the accompanying table FIG. 7*b* depicts the thicknesses of each layer of reinforcing materials that could be used to effect a series of five different sizes of arrow shafts that would be suitable for meeting the needs of virtually all hunting archers having draw lengths between 24" and 34", and using draw weights between 55# and 80#.

As stated earlier, these draw-length and draw-weight parameters have been selected solely for representative purposes, and in no way reflect limitations of the invention. It is known that the above referenced parameters would include approximately 95% of all hunting archers today. Of course continuing evolution in compound bows may, in the future, may serve to further modify arrow requirements. If this occurs in the future, as it has in the recent past, the arrow shafts of this invention may be adjusted, within the parameters of the invention, to serve different bow requirements as well, since the requirements for an optimum front-of-center balance point in the finished arrow, and additional strength at each end of the arrow shaft column will certainly be ongoing requirements for arrows, regardless of changes in terms of overall arrow weight and stiffness requirements mandated by changes to bows of various types.

For the arrows depicted in this "additional enabling information" section, a single multi-diameter core size has been selected, and the thicknesses of layers shown as (a) and (b) in FIG. 7*b*, which correlate to layers (17) and (18) in FIG. 4, have been held constant. This approach allows a single-size core configuration as well as a single-size and fixed-weight set of nock insert, nock, fletching, point insert, and related adhesive weights to be applicable for all different shaft sizes.

This approach also provides that a single point weight will suffice for all lengths of arrows made from a given size shaft, and that all shaft sizes will be able to use the same identical end-mounted components in terms of nock insert, nock, fletching, and point insert. Different shaft sizes may require a different single, fixed-weight point, in order to effect the desired 10–15% front-of-center balance point range in the finished arrow.

This approach works well in terms of meeting the objectives of the invention, since the invention calls for any given size shaft of the invention to require a single given point weight, used in conjunction with a single fixed-weight set of other end-mounted components, to effect a front-of-center balance point between ten and fifteen percent in front of the center, in the finished arrow, for all arrows having shaft-lengths between a desired length range. In the preferred embodiment, the shaft-length range has been selected to be between 24" and 34". However, neither the 24–34" shaft-length-range, or any other given shaft-length-range, or the selection of a prescribed 10–15% front-of-center balance point in the arrow is a requirement of the invention. The invention can be configured so as to work for any arrow-length-range and front-of-center balance point percentage that might be considered desirable.

It should be noted that a similar series of different sizes of shafts of the invention can also be made that all require not only the same identical point weight, but the same identical fixed weight of other end-mounted components such as nock, nock insert, fletching, and point insert; though this is not required to meet the objectives of the invention. Constructing different sizes of shafts of the invention that all required identical, fixed-weight, end-mounted components in terms of nock insert, nock, fletching, point insert, and point, would either require a series of different core configurations for each different size of shaft produced, some modification in the outside dimensions of some of the end-mounted components such as nock and point insert (to maintain identical weights in different sizes of the same end-mounted components), or perhaps doing some combination of both of these things.

The approach advised in this section of the patent application recognizes what is felt to be a superior format from a manufacturing standpoint, in that construction of all different shaft sizes mandates the least number of different core configurations to keep in inventory (a single core configuration), and further requires a single compliment of fixed-dimension and fixed-weight end-mounted components in terms of nock insert, nock, fletching, point insert, and adhesive weights for joining the end-mounted components to the shaft column, and further provides that all shaft sizes require the exact same wrapping and forming operations up until the point that the second layer of warp materials shown as layer (d) in FIG. 7*b*, and also shown as layer (20) in FIG. 4 and FIG. 5, is laid in place. Further, the approach being advised in this section requires only that layers (c) and (d) in FIG. 7*b*, which also correlates to layers (19) and (20) in FIG. 4 and FIG. 5 vary, by small margins, in constructing all five of the different shaft sizes described in this section.

While either approach can be successfully implemented within the framework of the invention, insofar as producing a given size of arrow shaft which requires a single, fixed-weight compliment of end-mounted components, for all draw lengths, this section on "additional enabling information" will concentrate on the approach that calls for using an identical core configuration for all shaft sizes. This approach is felt to provide the simplest means of meeting the needs of the greatest number of archers, while requiring the fewest number of different dimensions of end-mounted components overall.

Using the approach advised in this section, it is the case that only the point-weight itself need ever vary from one shaft size to the next. All of the other end-mounted components (nock, nock insert, fletching, point insert, and adhesives) as well as the underlying core configuration, remain constant for all different sizes of shafts produced.

Since existing manufacturer's currently produce a large variety of different points, including many different shapes and types in each of the various point weights needed to meet the needs of all of the different sizes of shafts described in the preferred embodiment, and in this section; the approach advised in this section is felt to provide the simplest means of introducing a suitable series of shafts of the invention into the market by those using the teachings of the invention.

It should be stressed that the approach being advised in this section is not in any way mandated by the invention, and that shafts of the invention can be configured, by varying the differences in outside-diameter of small and larger core segments, and varying the number, length, and placement of the additionally reinforced shaft sections, in different size shafts of the invention, and perhaps using different material selections, in a manner that would allow a single all-inclusive set of end-mounted components to meet the requirements for every different size of shaft of the invention, even though doing so has not been stated as an objective of the invention. This aspect of the invention is still however felt to represent an additional benefit of the invention over prior art approaches.

FIG. #7*b* illustrates, in tabular form, the approximate overall weights per inch of shafts of the preferred embodiment, with the weight-per-inch calculations being made for both those segments of the shaft which are underlaid by a smaller-diameter core section, and those segments of the shaft length that are underlaid by a larger-diameter core section. The weights shown are representative of shafts of the invention constructed using pre-impregnated columnar tapes. These types of tapes typically contain about 40% by weight of matrix-resin-based adhesive materials, and 60% by weight of reinforcing materials.

Each different size of shaft defined by the reinforcement thicknesses depicted in FIG. 7*b*, overlaying the smaller and larger outside-diameter core segments having radii as shown in FIG. 7*a*, and having smaller and larger outside-diameter core segments configured along the length of the shaft column as shown in FIG. 1, could successfully employ a single fixed-weight point, in conjunction with a single (for all shaft sizes) fixed-weight compliment of nock, nock insert, fletching, point insert, and adhesive quantity, to effect a front-of-center balance point between ten and fifteen percent, in all shafts of any given size within the series, cut to any length between 24" and 34".

As noted earlier, by selecting an appropriate ratio between the combined thicknesses of layers (a) and (b) in FIG. 7*b*, which further correspond to layers (17) and (18) in FIG. 4, and the combined thickness of layers (a) through (g), inclusive in FIG. 7*b*, which further correspond to layers (17) through (22), inclusive in FIG. 4, it is possible to construct a series of shafts of the invention that all require the same identical fixed-weight-point to achieve optimum balance in shafts of a given size cut to any length between 24" and 34".

As the combined thicknesses of layers (a) and (b) from FIG. 7*b* decrease as a percentage of the combined thicknesses or layers ((a), FIG. 7*b*) through ((g), FIG. 7*b*), inclusive; the total amount of point weight for a given shaft size increases, assuming all of the other end-mounted component weights (nock insert, nock, fletching, adhesives, and point insert) remains equal.

For example, when the ratio between these thickness measurements for shaft Size 0 as shown in FIG. 7*b*, is 0.012" to 0.034", said ratio yields a requirement for any single fixed-weight-point between 80 and 90 grains for any length of shaft between 24" and 34" in length, when the other back-end mounted components (nock insert, nock, fletching, and adhesives) total 75 grains in weight, and the other front-mounted components (point insert and adhesive) total 35 grains in weight. When the ratio between these thickness measurements is changed as in shaft Size 3 of FIG. 7*b*, to 0.012" to 0.042", the changed ratio yields a requirement for any single fixed-point-weight between 85 and 110 grains for any length of shaft between 24" and 34" in length, when the remaining front-end and back-end mounted components remain the same as used for shaft Size 0, in FIG. 7. When the same ratio is further changed as in shaft Size 5 of FIG.

7*b*, to be 0.012" to 0.050", the required single fixed-weight-point required is again increased to be in the range of 105 grains to 135 grains.

It is readily apparent from these calculations, that by holding the reinforcement thickness ratio defined in the preceding paragraph equal, for all different sizes of shafts of the invention, that a multitude of sizes of shafts of the invention could be produced that all required not only a single fixed point weight for a given shaft size, but the same identical point weight for all shaft sizes. Further the arrow builder could, by first selecting the appropriate ratio between these reinforcing material thickness layers, effectively design a series of shafts that all used the same identical, pre-determined, point-weight to achieve the desired front-of-center balance in all different shaft sizes of the series, and for all different lengths of shafts of the series cut to a length which fell between a pre-determined and desired minimum and maximum length.

Both of the immediate preceding approaches described in this section, relating to different embodiments that might be employed by those skilled in the art, in utilizing the teachings of the invention, have assumed that the sections of underlying core materials will be limited to one of two different diameters. Other possibilities certainly exist, including core sections which might have three, four, or even more different diameters at various points along the length of the shaft column.

A series of different shaft sizes using more than two different core diameters could also be made which incorporates the same smaller diameter core size for the back small-core section, and the intermediate (two) small-diameter core sections as shown in the preferred embodiment in FIG. 1, FIG. 2, and FIG. 3, but which allowed the frontmost small core section (only) to vary in a manner that produced a series of different shaft sizes, and overall finished arrow-weights, but which concurrently allowed each of the different shaft sizes to obtain the required front-of-center balance point, for all lengths of shafts, while using the same identical single fixed-weight of point.

The great number of possible combinations of shaft sizes, shaft weights, shaft outside diameters, differing-alternating-core-diameter configurations, and mixes of different materials suitable to the purposes of the invention, combined in a manner using the teachings of the invention, all of which fully accomplish all of the objectives of the invention, is believed to be a general benefit of the invention.

The five sizes shown in this section will meet the needs of over 95% of all hunting archers, yielding a series of arrows which vary in overall weight, including point, from approximately 390 grains for a 24" arrow using a shaft of the smallest size, to approximately 740 grains for a 34" arrow using a shaft of the largest size. The total number of shaft sizes of this invention, needed to meet the needs of the other 5% of hunting archers would probably be seven. One more very light weight size would be required for archers using compound bows in the 40# draw weight range (mostly children and young adults), and one more size for long draw-length archers using bows having draw weights between 80# and 100# (bows over 80# in draw weight are presently atypical, since most archery organizations prohibit bow draw-weights over 80# for competition). The estimated two additional sizes needed to meet the needs of the extreme limits of hunting bows at either the very light draw-weight or very heavy draw-weight ends of the spectrum could also easily be constructed by using the teachings of this invention, while modifying the variables noted herein appropriately. The 40# minimum bow weight for hunting bows is selected as a probable minimum requirement only, and is not a requirement of the invention.

Having thus described the background and advantages of my invention, and further having described the preferred embodiment of my invention, I now claim the following:

1. A composite arrow shaft comprising:

a) a solid central core section of lightweight material b) said central core section being substantially round at each point along it's length, and having at least two distinctly different outside diameters at different adjacent points along the length of the central core section c) said central core section being overwrapped with reinforcing materials, with the reinforcing materials cemented in place to the central core material, and with the reinforcing materials further cemented to themselves thereby forming a composite arrow shaft column structure d) said reinforcing materials surrounding the central core section such that the outside diameter of the finished arrow shaft column is of a substantially equal diameter over the entire length of the arrow shaft column, and such that the outside surfaces of the finished arrow shaft column are substantially parallel over it's entire length, and such that the front half of the finished arrow shaft column weighs more than the back half of the finished arrow shaft column, regardless of the amount of length of shaft column cut from either end or both ends of the finished shaft column in order to achieve the desired finished length in the arrow shaft column.

2. An arrow shaft as in claim 1, wherein the diameters of the central core are smaller at each end of the shaft column than at least one point along the length of the shaft column that is intermediate to the ends of the shaft column.

3. An arrow shaft as in claim 1, wherein the diameters of the central core at each end of the shaft column and at least one point along the overall length of the shaft column intermediate to the endmost smaller diameter central core sections are smaller than the diameter of the central core at at least one other point along the length of the shaft column that is between the endmost two smaller diameter central core sections.

4. A composite arrow shaft comprising:

a) a central core section of lightweight material, with the central core incorporating a lengthwise hole throughout at least a part of it's length b) said central core section being substantially round at each point along it's length, and having at least two distinctly different outside diameters at different adjacent points along the length of the central core section c) said central core section being overwrapped with reinforcing materials, with the reinforcing materials cemented in place to the central core material, and with the reinforcing materials further cemented to themselves, thereby forming a composite arrow shaft column structure d) said reinforcing materials surrounding the central core section such that the outside diameter of the finished arrow shaft column is of a substantially equal diameter over the entire length of the arrow shaft column, and such that the outside surfaces of the finished arrow shaft column are substantially parallel over it's entire length, and such that the front half of the finished arrow shaft column weighs more than the back half of the finished arrow shaft column, regardless of the amount of length of shaft column cut from either end or both ends of the finished shaft column in order to achieve the desired finished length in the arrow shaft column.

5. An arrow shaft as in claim 4, wherein the outside diameters of the central core section are smaller at each end of the shaft column than at least one point along the length of the shaft column that is intermediate to the ends of the shaft column.

6. An arrow shaft as in claim 4, wherein the outside diameters of the central core section at each end of the shaft column and at at least one other point along the overall length of the shaft column intermediate to the endmost smaller diameter central core sections, are smaller than the outside diameter of the central core section at at least one other point along the length of the shaft column that is between the endmost two smaller outside diameter central core sections.

7. A substantially round tubular arrow shaft formed from composite materials such that the outside diamater of the shaft column is substantially the same over it's entire length, having inside tube diameters which are smaller at each end of the tube than at points intermediate the ends of the tube, such that the composite materials comprising the tube walls are thicker at those points along the shaft column that have smaller inside diameters, with the lengths of tube sections having smaller inside diameters being configured so that the front half of the arrow shaft column weighs more than the back half of the arrow shaft column, regardless of the amount of length of shaft column cut from either or both ends of the shaft column in order to achieve the desired length in the finished arrow shaft column.

8. An arrow shaft as in claim 7, wherein the inside diameter of the tubular shaft column is smaller than the inside diameter at at least one other point along the length of the shaft column in addition to the two endmost sections of the shaft column.

9. A substantially round tubular arrow shaft formed from composite materials such that the outside diamater of the shaft column is substantially the same over it's entire length, having an inside diameter which is smaller at the intended front end of the tube than at the intended back end of the tube such that the composite materials comprising the tube walls are thicker at those points along the shaft column that has the smaller inside diameter, with the lengths of tube sections having smaller inside diameters being configured so that the front half of the arrow shaft column weighs more than the back half of the arrow shaft column, regardless of the amount of length of shaft column cut from either or both ends of the shaft column in order to achieve the desired length in the finished arrow shaft column.

* * * * *